US009623682B2

(12) United States Patent
Hosoda

(10) Patent No.: US 9,623,682 B2
(45) Date of Patent: Apr. 18, 2017

(54) PRINTING APPARATUS, METHOD FOR CONTROLLING THE SAME, AND STORAGE MEDIUM

(71) Applicant: CANON KABUSHIKI KAISHA, Tokyo (JP)

(72) Inventor: Yuichi Hosoda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 14/754,169

(22) Filed: Jun. 29, 2015

(65) Prior Publication Data

US 2015/0375538 A1 Dec. 31, 2015

(30) Foreign Application Priority Data

Jun. 30, 2014 (JP) ..... 2014-135385

(51) Int. Cl.

| | |
|---|---|
| ***B41J 29/38*** | (2006.01) |
| ***B41J 13/00*** | (2006.01) |
| ***B65H 1/00*** | (2006.01) |
| ***G03G 15/00*** | (2006.01) |
| ***B65H 31/24*** | (2006.01) |
| ***B65H 31/02*** | (2006.01) |
| ***B65H 31/30*** | (2006.01) |
| ***B65H 43/00*** | (2006.01) |

(52) U.S. Cl.

CPC ..... *B41J 13/0009* (2013.01); *B65H 1/00* (2013.01); *B65H 31/02* (2013.01); *B65H 31/24* (2013.01); *B65H 31/3081* (2013.01); *B65H 43/00* (2013.01); *G03G 15/6529* (2013.01); *G03G 15/6552* (2013.01); *B65H 2301/4212* (2013.01); *B65H 2301/4213* (2013.01); *B65H 2402/443* (2013.01); *B65H 2405/332* (2013.01); *B65H 2408/111* (2013.01); *B65H 2511/412* (2013.01); *G03G 2215/00421* (2013.01); *G03G 2215/00679* (2013.01)

(58) Field of Classification Search

None

See application file for complete search history.

(56) References Cited

U.S. PATENT DOCUMENTS

2005/0270355 A1* 12/2005 Sootome et al. ..... 347/104

FOREIGN PATENT DOCUMENTS

| | | | |
|---|---|---|---|
| JP | 2003-191578 A | | 7/2003 |
| JP | 2013-220905 A | | 10/2013 |
| JP | 2013220905 A | * | 10/2013 |

* cited by examiner

*Primary Examiner* — Matthew Luu
*Assistant Examiner* — Tracey McMillion
(74) *Attorney, Agent, or Firm* — Canon U.S.A., Inc. IP Division

(57) ABSTRACT

A printing apparatus includes a conveying unit that conveys a stored sheet to a position where the sheet can be picked up based on received instructions to pick up the stored sheet on which an image is printed. The printing apparatus performs control such that the sheet is not conveyed by the conveying unit while the sheet is being stored in the storage unit.

15 Claims, 13 Drawing Sheets

PRINTING APPARATUS, METHOD FOR CONTROLLING THE SAME, AND STORAGE MEDIUM

BACKGROUND

Field

Aspects of the present invention generally relate to a printing apparatus for printing an image on a sheet, a method for controlling the same, and a storage medium.

Description of the Related Art

A conventional printing apparatus for printing an image on a sheet, after making prints, outputs a sheet on which an image is printed (a printed product) to the outside. In recent years, there has been proposed a mechanism for temporarily retaining a printed product in an apparatus instead of outputting the printed product to the outside of the apparatus immediately after printing.

A printing apparatus discussed in Japanese Patent Application Laid-Open No. 2013-220905 incorporates a plurality of sheet storing units therein. A printed product is once stored in any one of the storing units. The printing apparatus has a function to authenticate a user and conveys the printed product corresponding to the authenticated user from among the printed products stored in the plurality of sheet storing units. When the conveyance is finished, the printed product is partially exposed toward the outside of the apparatus. The user extracts the partially exposed printed product to receive his/her printed product.

Such a configuration not only prevents the printed product from meeting eyes of others and prevents confidential information from leaking but also can improve an operating efficiency in such a manner that printing is started before the user arrives a place where the printing apparatus is installed.

Japanese Patent Application Laid-Open No. 2003-191578 discusses a printing apparatus configured to display a list of users corresponding to printed products stored in a sheet storing unit. The printing apparatus discussed in Japanese Patent Application Laid-Open No. 2003-191578 is configured to drive a mechanism in the sheet storing unit which is storing printed products corresponding to selected users, so as to make the printed product retrievable when a user selects a user name.

The printing apparatus discussed in Japanese Patent Application Laid-Open No. 2013-220905 is configured such that an extrusion member provided in the sheet storing unit is moved to push an upstream edge (trailing edge) in the direction in which a stored sheet is conveyed, exposing a part of a downstream edge (leading edge) in the direction in which the sheet is conveyed outside the apparatus. However, when the new sheet is stored leaving the already stored sheet exposed toward the outside of the apparatus, it is probable that the newly stored sheet interferes with the extrusion member because the extrusion member is in a displaced state. As a result, the sheet may be stored in an incorrect position or a jam error or a sheet bend may occur.

SUMMARY

Aspects of the present invention are generally directed to providing a mechanism capable of preventing a jam error from occurring in a sheet storing unit.

According to an aspect of the present invention, a printing apparatus includes a printing unit configured to print an image on a sheet, a storage unit configured to store the sheet on which the image is printed, a conveying unit configured to convey the sheet stored in the storage unit to a position where the sheet can be picked up based on received instructions to pick up the sheet stored in the storage unit, and a control unit configured to perform control such that the sheet is not conveyed by the conveying unit while the sheet is being stored in the storage unit.

Further features of the present disclosure will become apparent from the following description of exemplary embodiments with reference to the attached drawings.

DESCRIPTION OF THE EMBODIMENTS

The present exemplary embodiment is detailed below with reference to the attached drawings. The following exemplary embodiments are not seen to be limiting and not all of combinations of the characteristics described in the present exemplary embodiments are essential to implementing the exemplary embodiments.

Figure 1:
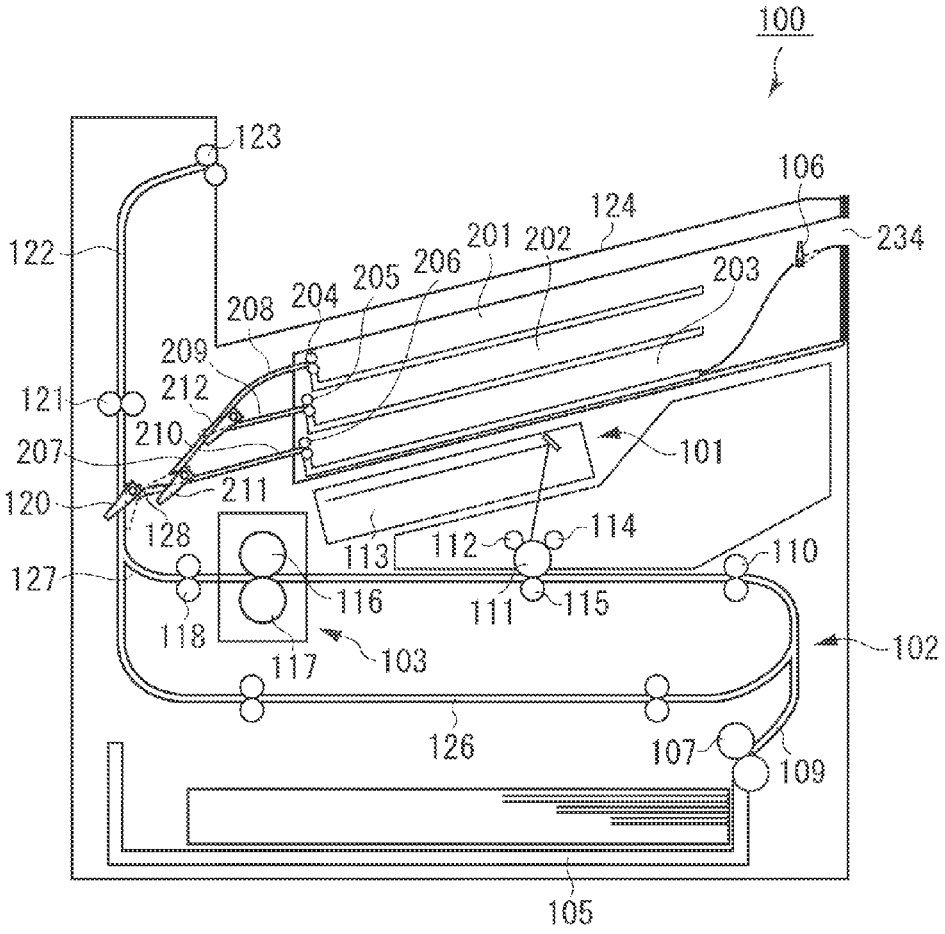
FIG. 1 is a cross section of a printing apparatus according to an exemplary embodiment.

A first exemplary embodiment is described below. FIG. 1 is a cross section of a monochrome digital printer illustrated as an example of a printing apparatus to which the present exemplary embodiment is applied. A printing apparatus 100 illustrated in FIG. 1 is an entire printing apparatus. The printing apparatus 100 includes a printer unit 101. A sheet conveying unit 102 conveys a sheet to the printer unit 101. A fixing unit 103 fixes an image on the sheet. A stacking unit 124 provided on the upper face of the printing apparatus 100 stacks sheets (printed products) on which images are printed by the printer unit 101. The printed products output to the stacking unit 124 can be picked up by the user without giving any instructions for picking-up which is described below.

Three sheet storing units 201, 202, and 203 store sheets (printed products) on which images are printed by the printer unit 101, within the apparatus and are provided between the printer unit 101 and the stacking unit 124. The printed products stored in the sheet storing units 201, 202, and 203 are conveyed outside the apparatus so as to be partially exposed in response to the picking-up instructions described below and can be extracted by the user. The example apparatus uses three sheet storing units, however, the number of the sheet storing units is not limited to three.

The printer unit 101 includes a photosensitive drum 111 which can rotate clockwise, an exposure unit 113, and a charging roller 112 arranged along the direction in which the photosensitive drum 111 is rotated, a developing unit 114, and a transfer roller 115 in FIG. 1. The printer unit 101 forms a toner image on the sheet using the above members.

The sheet conveying unit 102 includes a feeding cassette 105 for storing a plurality of stacked printing sheets, a feeding roller 107, a conveyance guide 109, and a registration roller 110. The fixing unit 103 includes a fixing roller 116, a pressure roller 117 on which the fixing roller 116 abuts downward, and a conveyance roller 118. A sheet reconveying path 126 used in printing an image on a double-sided sheet is provided among the printer unit 101, the fixing unit 103, and the feeding cassette 105.

A conveyance roller 204 conveys the sheet to a first sheet storing unit 201. Similarly, a conveyance roller 205 conveys the sheet to a second sheet storing unit 202 and a conveyance roller 206 conveys the sheet to a third sheet storing unit 203.

A conveyance-path switching member 120 is capable of switching the conveyance-path between a first position indicated by a solid line and a second position indicated by a broken line in FIG. 1. The conveyance-path switching member 120 uses an actuator (not illustrated) for switching between positions indicated by the solid and broken lines in FIG. 1. Reversing rollers 121 and 123 are reversible. The Reversing rollers 121 and 123 are normally rotated to output the sheet to the stacking unit 124 or reversely rotated to convey the sheet to the reconveying path 126.

When the sheet is conveyed to the stacking unit 124, the conveyance-path switching member 120 is switched to the position indicated by the broken line, the conveyance roller 121 conveys the sheet along an output guide 122, and the reversing roller 123 outputs the sheet to the stacking unit 124.

When an image is printed on both sides of the sheet, the sheet with a toner image fixed on one side (surface) is conveyed to the reversing roller 123. The reversing rollers 121 and 123 are reversely rotated after the trailing edge of the sheet passes a branch portion 127 to switch back the sheet and re-convey it to the printer unit 101 via the reconveying path 126.

If the sheet is conveyed to the sheet storing unit 201, 202, or 203, the conveyance-path switching member 120 is switched to the position indicated by the solid line and the sheet is conveyed to the sheet storing unit 201, 202, or 203 via a conveyance path 128. First and second switching members 211 and 212 switch paths along which the sheet is conveyed. The first and second switching members 211 and 212 use an actuator (not illustrated) to switch positions indicated by the solid and broken lines in FIG. 1.

If the sheet is conveyed to the first sheet storing unit 201, the first and second switching members 211 and 212 are switched to and held at the position indicated by the solid line in FIG. 1. The sheet on which the image is printed passes the conveyance path 128 and conveyance guides 207 and 208 in this order. Furthermore, the conveyance roller 204 stores the sheet face-down in the first sheet storing unit 201, in other words, with the face, on which the toner image is printed, directed downward.

If the sheet is conveyed to the second sheet storing unit 202, the first and second switching members 211 and 212 are switched to and held at the positions indicated by the solid and broken lines in FIG. 1 respectively. The sheet on which the image is printed passes the conveyance path 128 and conveyance guides 207 and 209 in this order. Furthermore, the conveyance roller 205 stores the sheet face-down in the second sheet storing unit 202, in other words, with the face, on which the toner image is printed, directed downward.

If the sheet is conveyed to the third sheet storing unit 203, the first switching member 211 is switched to and held at the positions indicated by the broken line in FIG. 1. The sheet on which the image is printed passes the conveyance path 128 and the conveyance guide 210 in this order. Furthermore, the conveyance roller 206 stores the sheet face-down in the third sheet storing unit 203, in other words, with the face, on which the toner image is printed, directed downward.

Sheets stored in the sheet storing unit 201, 202, or 203 are conveyed to a discharge port 234 in accordance with a user's picking-up instruction. The conveyance is described in detail below with reference to FIGS. 2 and 3. The sheet conveyed to the discharge port 234 is held with the sheet partially exposed outside the apparatus and waits for the user to extract the sheet. A member 106 detects that the sheet conveyed to the discharge port 234 is extracted by the user. The member 106 is in the position indicated by the solid line in FIG. 1 until the sheet is conveyed to the discharge port 234 (and after the user extracts the conveyed sheet). The member 106 is in the position indicated by the broken line while the sheet waits for the user to extract it. A single discharge port 234 common to the sheet storing units 201, 202, and 203 is used here as an example, however, a dedicated discharge port may be provided for each sheet storing unit.

The configuration of the sheet storing unit is described in detail below with reference to FIG. 2. The printing apparatus 100 is provided with a plurality of the sheet storing units 201, 202, and 203 which are stacked one on top of another. Each sheet storing unit is similar in configuration. Therefore, the configuration of the sheet storing unit 201 is described below.

The sheet conveyed to the first sheet storing unit 201 by the conveyance roller 204 is stacked on a stacking face 231 to be temporally stored. A detection can be made by a sheet presence/absence detecting unit (not illustrated) as to whether the sheet is stacked on the stacking face 231 (whether the sheet storing unit is vacant). An extrusion member 233 is configured to push an upstream edge (trailing edge) in the direction in which a stored sheet is conveyed, such that a part of a downstream edge (leading edge) is exposed outside in the sheet-conveyance direction via the discharge port 234. The extrusion member 233 extrudes the sheet to the discharge port 234 to enable the user to extract the sheet. The length of the sheet exposed outside by the extrusion member 233 shall be 30 mm, however, the length is not limited to 30 mm so long as the user can grasp the sheet and the sheet does not fall off under its own weight.

Restrictions are set on the number of sheets and the size of the sheet which can be stored in the sheet storing units 201, 202, and 203 of the printing apparatus. More specifically, one sheet storing unit can store only 15 plain papers at a time. A detection as to whether sheets are fully stacked on the sheet storing unit is made by using a full-state detection lever 235. If a paper thicker than a plain paper is used, the number of storable sheets may be decreased. If sheets are fully stacked on the sheet storing unit, the tilt of the full-state detection lever 235 varies and the variance is detected by a photo interrupter. A signal indicating a detection result is input into a control unit 501 of FIG. 5 as described below.

Figure 2:
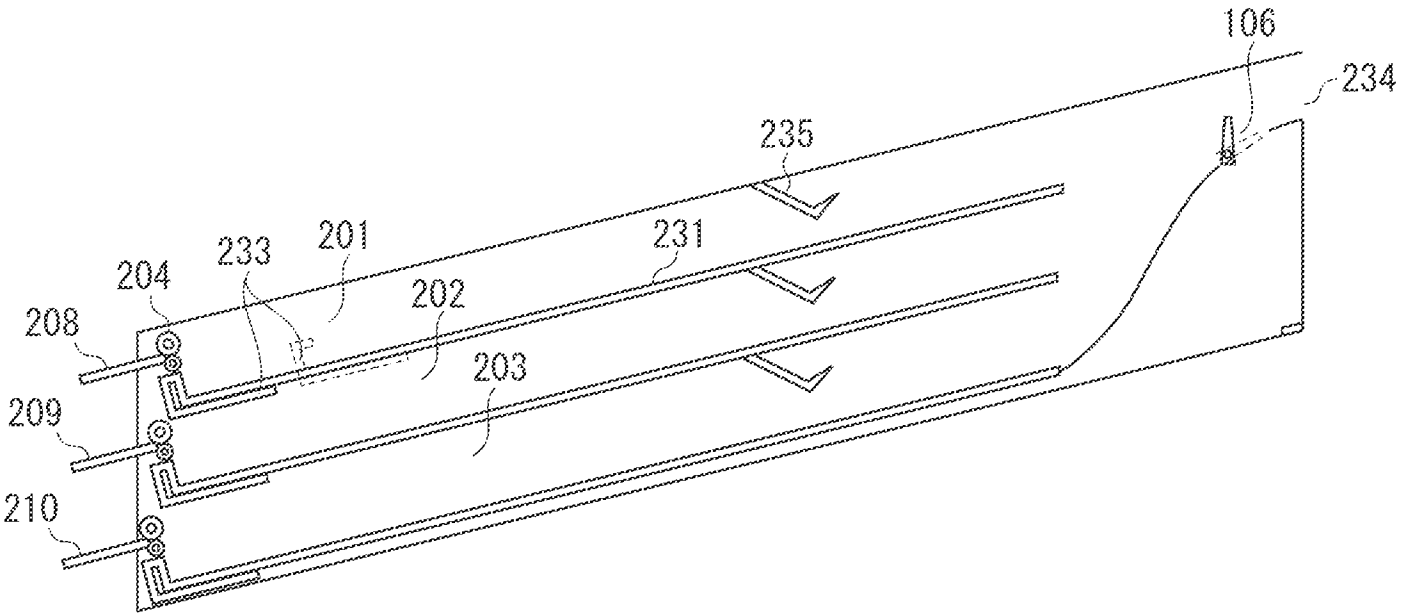
FIG. 2 is a cross section of a sheet storing unit according to the exemplary embodiment.

When the sheets are being stored in the first sheet storing unit 201, the extrusion member 233 is placed in a stack position indicated by the solid line in FIG. 2 which does not interfere with the conveyance and stack of the sheets. On the other hand, when the stored sheets are extruded, the extrusion member 233 is moved toward the discharge port 234 along the sheet output direction and is moved to an extrusion position (a sheet output position) indicated by the broken line. Thereafter, when the member 106 detects that the sheet is extracted by the user, the extrusion member 233 is returned to the stack position.

Figure 3A:
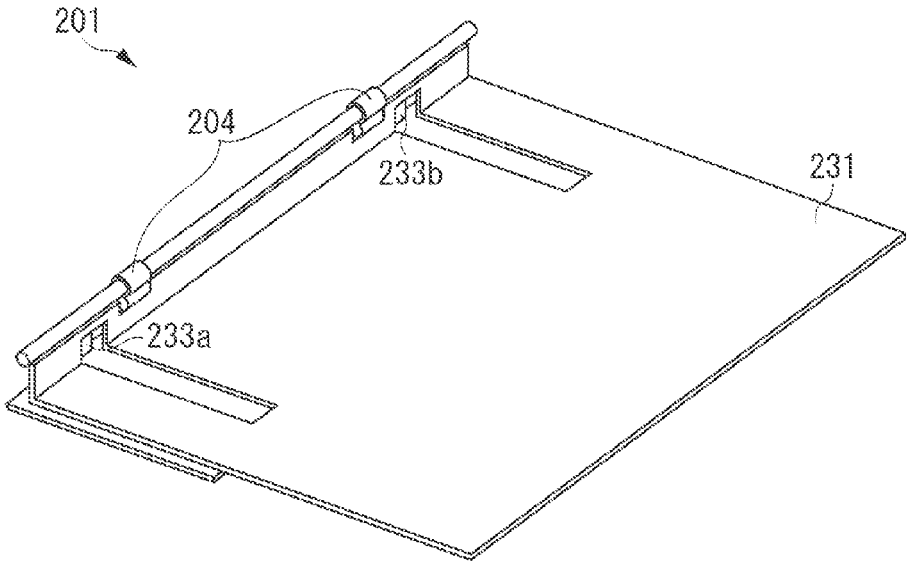
FIGS. 3A and 3B are perspective views of the sheet storing unit according to the exemplary embodiment.
Figure 3B:
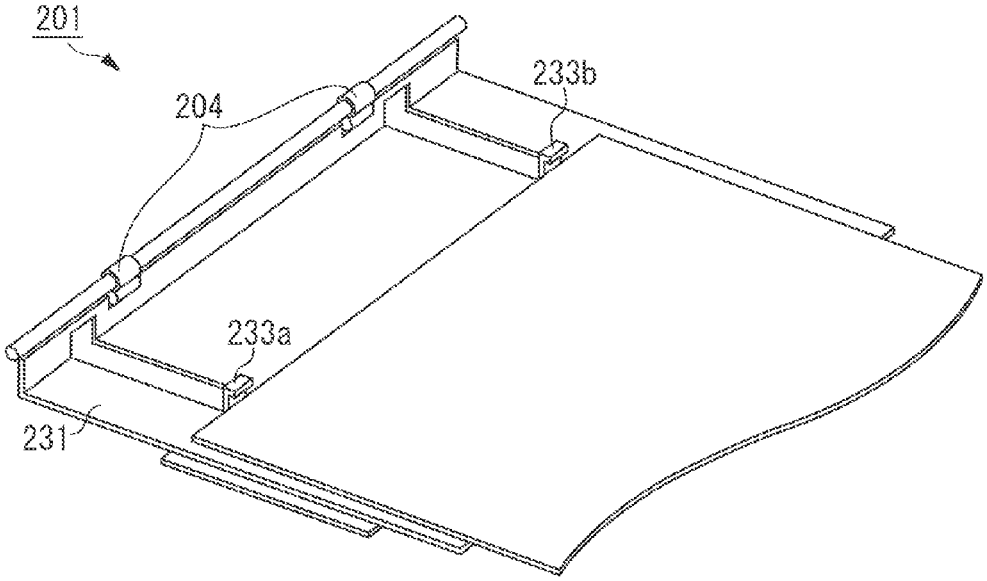

FIGS. 3A and 3B are perspective views of the sheet storing unit 201. In FIG. 3A, the extrusion member 233 is in the stack position. In FIG. 3B, the extrusion member 233 is in the extrusion position. The extrusion member 233 has two sheet trailing-edge extrusion claws 233*a* and 233*b* across the sheet width direction to prevent the sheet from being rotated along with the output of the sheet. When the sheet is extruded, the sheet trailing-edge extrusion claws 233*a* and 233*b* press the upstream edge of the sheet to output the sheet. The extrusion member 233 is reciprocated between the stack position and the extrusion position along the sheet output direction.

Figure 4:
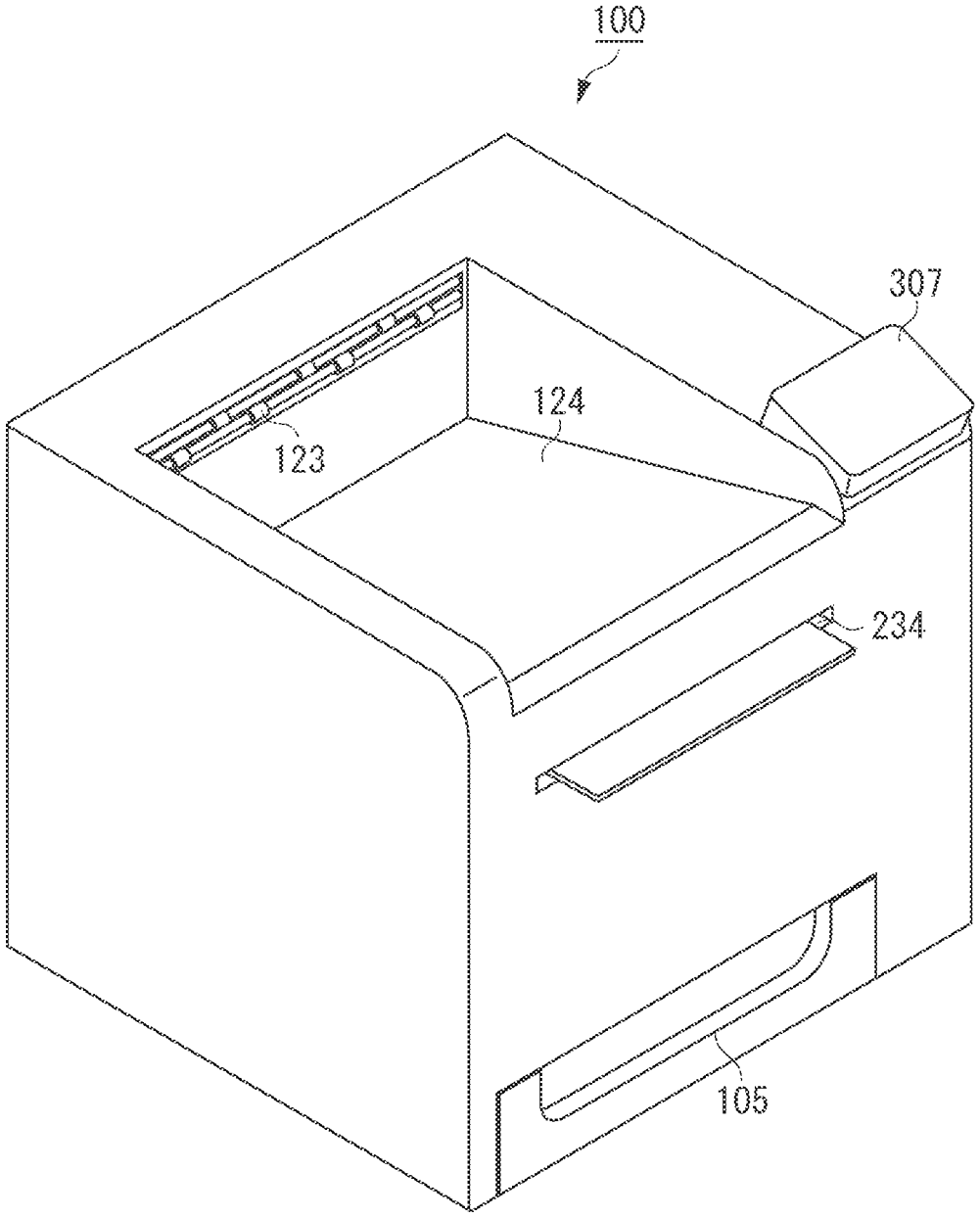
FIG. 4 is an external perspective view of the printing apparatus according to the exemplary embodiment.

FIG. 4 is an external perspective view of the printing apparatus 100. A downstream edge of a sheaf of sheets output from any one of the sheet storing units 201, 202, and 203 is exposed from the discharge port 234. The user can receive his/her printed product by holding the exposed downstream edge outside the apparatus and pulling the sheaf of sheets. An operation display unit 307 is capable of receiving instructions for the printing apparatus 100 from the user and displaying a screen for notifying the user of various types of information. The operation display unit 307 has a touch panel function. The control unit 501 described below determines the contents of instructions from the user according to a touched position.

Figure 5:
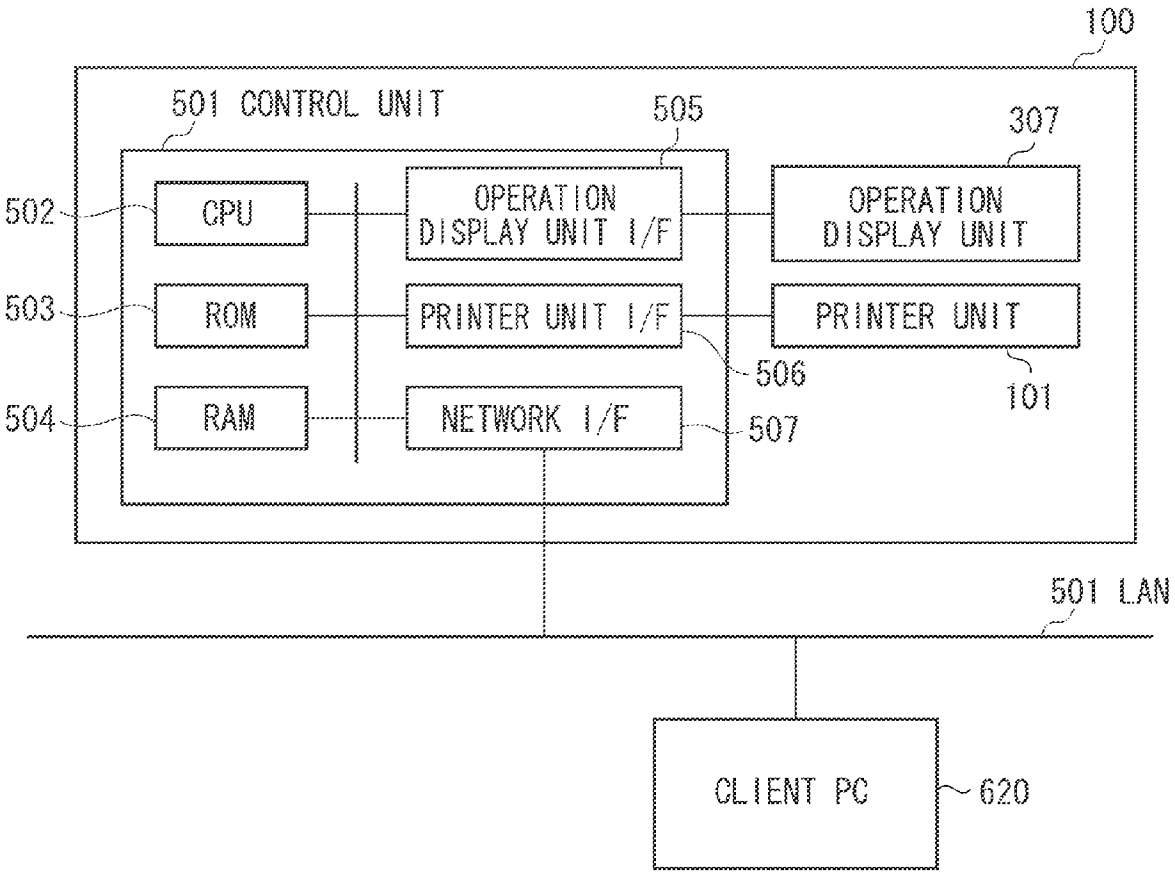
FIG. 5 is a hardware block diagram of a printing system apparatus according to the exemplary embodiment.

FIG. 5 is a hardware block diagram of the printing apparatus 100. The control unit 501 including a central processing unit (CPU) 502 controls the entire operation of the printing apparatus 100. The CPU 502 reads the control program stored in a read only memory (ROM) 503 to control printing operation and sheet conveyance. A random access memory (RAM) 504 is used as a main memory of the CPU 502 and a temporary storage area such as a work area. In the printing apparatus 100, one CPU 502 executes each process illustrated in a flow chart described below using one RAM 504, however, another configuration may be used. For example, the printing apparatus 100 may be provided with a plurality of CPU, which in cooperation with a plurality of RAMs carry out various processes.

An operation display unit interface (I/F) 505 connects the control unit 501 with an operation display unit 307. The operation display unit 307 acts as a reception unit for receiving printed-product picking-up instructions described below and displays a screen illustrated in FIG. 8.

A printer unit interface (I/F) 506 connects the control unit 501 with the printer unit 101. An image to be printed by the printer unit 101 is transferred from the control unit 501 via the printer unit I/F 506 to the printer unit 101 and printed on the sheet by the printer unit 101.

A network interface (I/F) 507 connects the printing apparatus 100 with a local area network (LAN) 510. The LAN 510 is connected with a client personal computer (PC) 620. The network I/F 507 receives a print job generated by a printer driver installed in the client PC 620.

Figure 6:
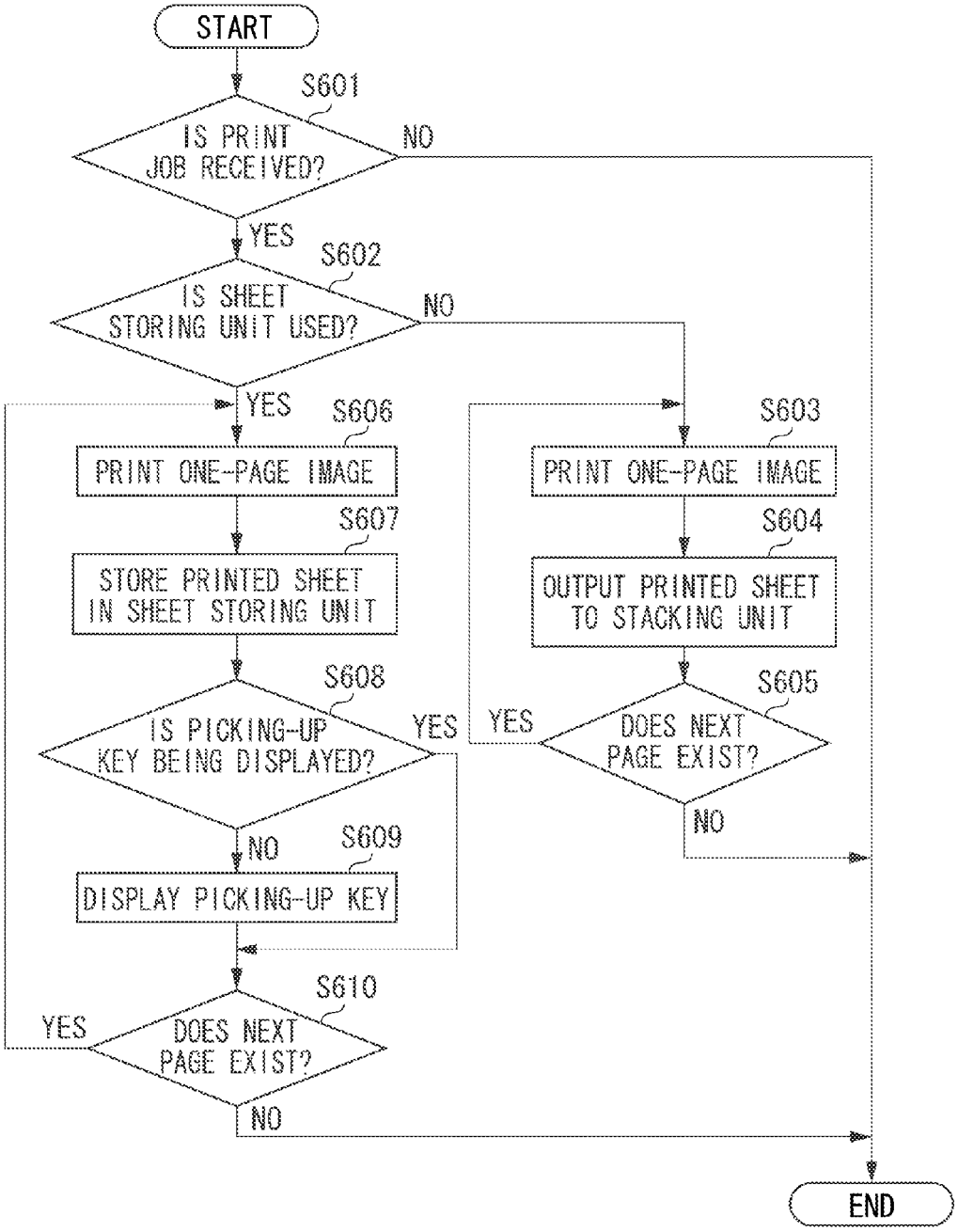
FIG. 6 is a flow chart illustrating the operation of the printing apparatus according to the exemplary embodiment.

FIG. 6 is a flow chart illustrating the operation of the printing apparatus 100 in a case where the print job is received from the client PC 620. Each operation (step) illustrated in the flow chart in FIG. 6 is realized by the control unit 501 of the printing apparatus 100 executing the control program stored in the ROM 503. The flow chart in FIG. 6 shall be continuously executed (that is, the process proceeds from the start to the end and thereafter the process is resumed without substantial intermission).

In step S601, it is determined whether a print job is received. If it is determined that the print job is received (YES in step S601), the processing proceeds to step S602. If it is determined that the print job is not received (NO in step S601), the processing ends.

In step S602, it is determined whether the sheet storing unit is used (whether the use of the sheet storing unit is set in the received print job). If it is determined that the sheet storing unit is not used (NO in step S602), the processing proceeds to step S603. If it is determined that the sheet storing unit is used (YES in step S602), the processing proceeds to step S606.

In step S603, a one-page image based on the print job is printed on the sheet. In step S604, the printed sheet is output to the stacking unit 124. If a plurality of pages is to be printed on one sheet, in step S603, images for the plurality of pages are collectively printed. In step S605, it is determined whether the next page exists. If the next page exists (YES in step S605), the processing returns to step S603. If the next page does not exist (NO in step S605), the processing ends.

In step S606, a one-page image based on the print job is printed on the sheet. In step S607, the printed sheet is stored in the sheet storing unit 202 (here is described an example in which the printed sheet is stored in the sheet storing unit 202 among the three sheet storing units). If a plurality of pages is printed on one sheet, in step S606, images for the plurality of pages are collectively printed.

In step S608, it is determined whether the picking-up key corresponding to the sheet storing unit 202 is already displayed. The picking-up key is an operation key for receiving instructions to pick up the sheet stored in the sheet storing unit from the user as described below using FIG. 7. If it is determined that the picking-up key is already displayed (YES in step S608), the processing proceeds to step S610. If it is determined that the picking-up key is not yet displayed (NO in step S608), the processing proceeds to step S609.

In step S609, the picking-up key corresponding to the sheet storing unit 202 is displayed on the operation display unit 307. In step S610, it is determined whether the next page exists. If the next page exists (YES in step S610), the processing returns to step S606. If the next page does not exist (NO in step S610), the processing ends.

Figure 7A:
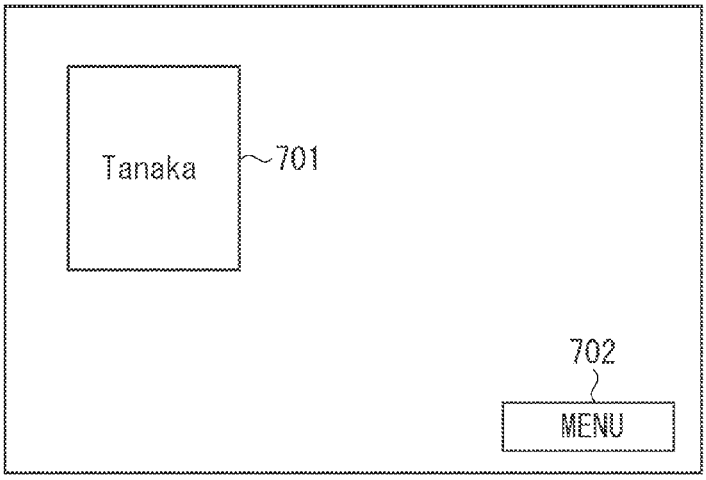
FIGS. 7A, 7B, and 7C illustrate examples of screens displayed on the printing apparatus according to the exemplary embodiment.
Figure 7B:
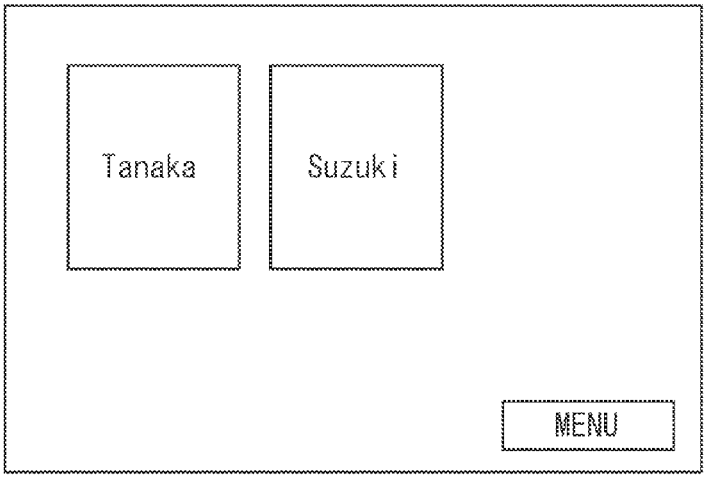
Figure 7C:
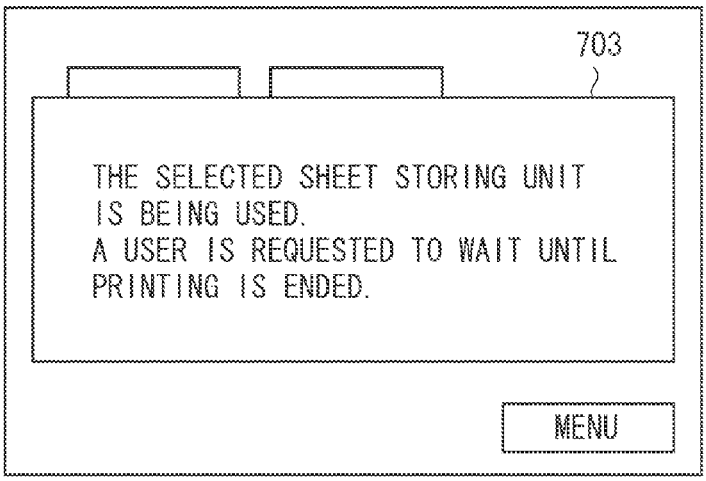

FIGS. 7A, 7B, and 7C illustrate examples of screens for receiving instructions for picking up. The screens illustrated in FIGS. 7A, 7B, and 7C are displayed on the operation display unit 307. FIG. 7A corresponds to a state where the sheet whose user name is "Tanaka" is stored in the sheet storing unit 201. A display object 701 is a picking-up key for receiving instructions to pick up the sheet stored in the sheet storing unit from the user and displays a user name. The user can issue instructions to pick up the sheet by operating (pressing) the picking-up key. A display object 702 is an operation key for displaying a menu screen. The operated (pressed) key displays a menu screen (not illustrated).

Because no sheet is stored in the sheet storing units 202 and 203, the picking-up key corresponding to the sheet storing units 202 and 203 is not displayed.

A job of a user whose name is "Suzuki" is executed in this state to change the display screen into a state illustrated in FIG. 7B through the processing in step S609. The comparison of FIG. 7A with FIG. 7B reveals that a display object displaying a name of "Suzuki" is added as the picking-up key corresponding to the sheet storing unit 202.

Figure 8:
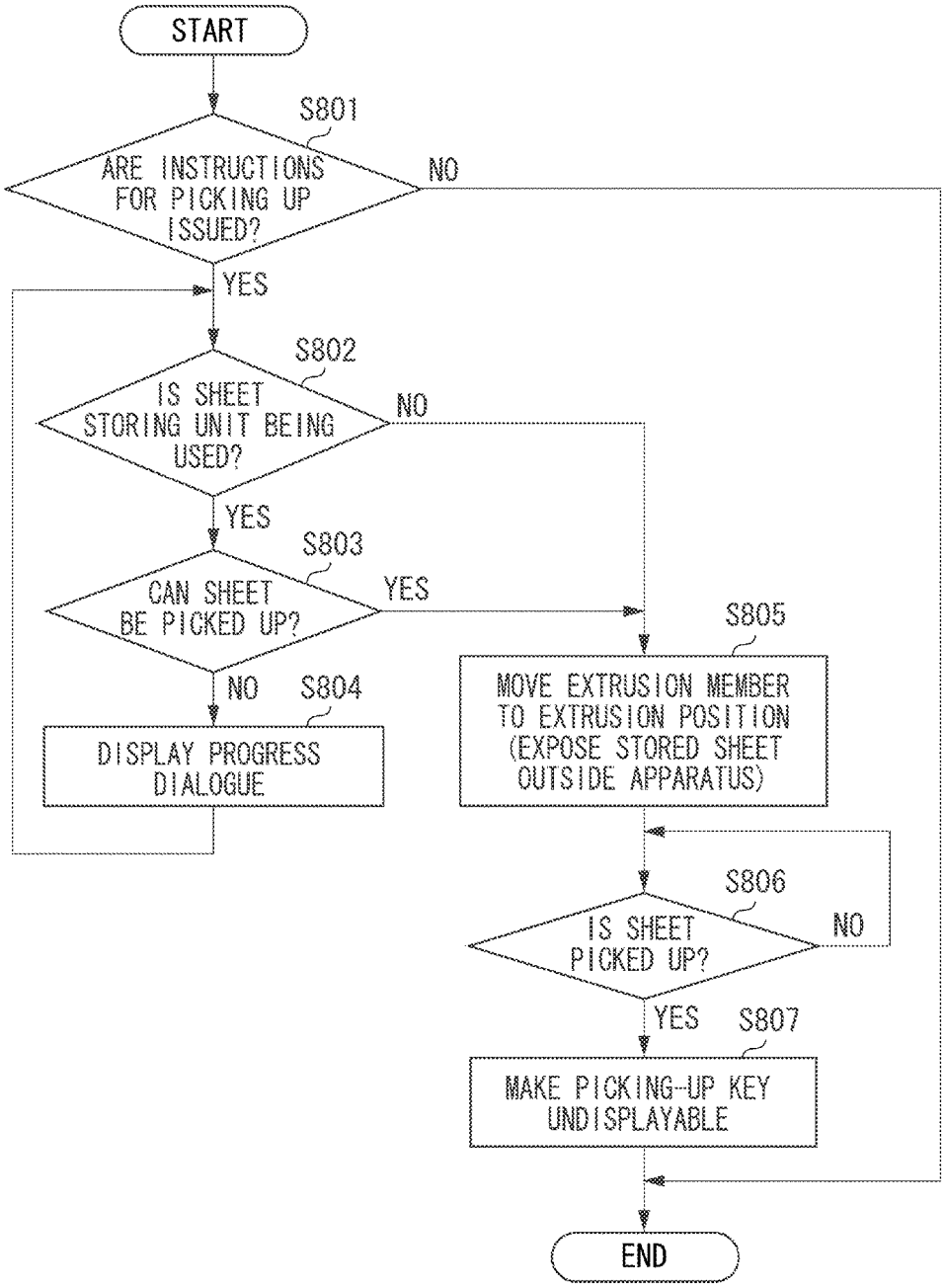
FIG. 8 is a flow chart illustrating the operation of the printing apparatus according to the exemplary embodiment.

FIG. 8 is a flow chart illustrating the operation of the printing apparatus 100 in a case where the user picks up the sheet stored in the sheet storing units. Each operation (step) illustrated in the flow chart in FIG. 8 is realized by the control unit 501 of the printing apparatus 100 executing the control program stored in the ROM 503. The flow chart in FIG. 8 shall be continuously executed (that is, the process proceeds from the start to the end and thereafter the process is resumed without substantial intermission).

In step S801, it is determined whether instructions for picking up are issued. If the picking-up key illustrated in FIGS. 7A and 7B is operated, it is determined that the instructions for picking up are issued (YES in step S801) and the processing proceeds to step S802. If it is determined that the instructions for picking up are not issued (NO in step S801), the processing ends.

In step S802, it is determined whether the sheet storing unit corresponding to the operated picking-up key is being used for printing at present. The phrase "being used for printing" means that the job associated with storage of the sheet into the corresponding sheet storing unit is being executed at present and the sheet is not yet stored. For this reason, when printing is finished and all sheets are stored, a state of "being used for printing" is finished. Even if the job associated with storage of the sheet into the corresponding sheet storing unit is not yet executed, an execution wait state (being put into an execution queue) may be handled as a state of "being used for printing."

If it is determined that the sheet storing unit is being used for printing at present (YES in step S802), the processing proceeds to step S803. If it is determined that the sheet storing unit is not being used for printing at present (NO in step S802), the processing proceeds to step S805. In step S803, it is determined whether it is permitted to pick up the sheet from the sheet storing unit being used for printing at present. The determination is made based on the contents predetermined by an administrator of the printing apparatus 100. Even while a sheet storing unit is being used for printing, the sheet can be physically picked up from the sheet storing unit of the printing apparatus 100. However, if a new sheet is stored into the sheet storing unit with the extrusion member 233 moved to the extrusion position, the sheet to be newly stored may interfere with the extrusion member 233. This may cause a problem that the sheet is stored in an incorrect position or a jam error or a sheet bend occurs. For this reason, the administrator who wants to reduce the jam error to a minimum performs setting so as to restrict picking up of the sheet while the printing is being made. On the other hand, if the administrator gets the convenience of picking up the sheet during the printing, the administrator performs setting so as to permit picking-up of the sheet during the printing.

If it is determined that it is permitted to pick up the sheet (YES in step S803), the processing proceeds to step S805. If it is determined that it is not permitted to pick up the sheet (NO in step S803), the processing proceeds to step S804. In step S804, a progress dialogue illustrated in FIG. 7C is displayed. The dialogue reads: the sheet storing unit selected by the user is being used at present, so that the user is requested to wait until the printing is ended. After step S804 is performed, the processing returns to step S802 to repeat the determination until the printing is ended.

In step S805, the extrusion member 233 is moved to the extrusion position to expose the stored sheet outside the apparatus. In step S806, it is determined whether the sheet exposed in step S805 is picked up based on the result detected by the member 106. If it is determined that the sheet is picked up (YES in step S805), the processing proceeds to step S807 to render the picking-up key in an undisplayable state. At this point, the extrusion member 233 is returned to the stack position.

As described above, according to the first exemplary embodiment, the jam error can be prevented in such a manner that the conveyance of the sheet to be picked up is restricted if an instruction is issued to pick up the sheet from the sheet storing unit which is being used at present. The determination in step S803 can be made based on the size or type of the sheet stored in the sheet storing unit and/or a sheet to be newly stored instead of the setting by the administrator. Thus, the conveyance of the sheet to be picked up can be restricted in the case the size or type of the sheet is vulnerable to the jam error, and the conveyance of sheets other than that size or type can be permitted. Alternatively, the processing may proceed directly to step S804 from step S802 (YES) without providing the branch of step S803 and restrict picking up of the sheet from the sheet storing unit being used at present without exception.

The second exemplary embodiment is described below. The first exemplary embodiment has described an example in which the conveyance of the sheet to be picked up is restricted in a case where instructions to pick up the sheet from the sheet storing unit are received and then the sheet storing unit is being used at present. On the other hand, a second exemplary embodiment describes an example in which a picking-up key corresponding to the sheet storing unit which is being used for printing at present is displayed in an inoperable state. In the following, only points different from those of the first exemplary embodiment are described and points other than that shall be the same as those of the first exemplary embodiment.

Figure 9:
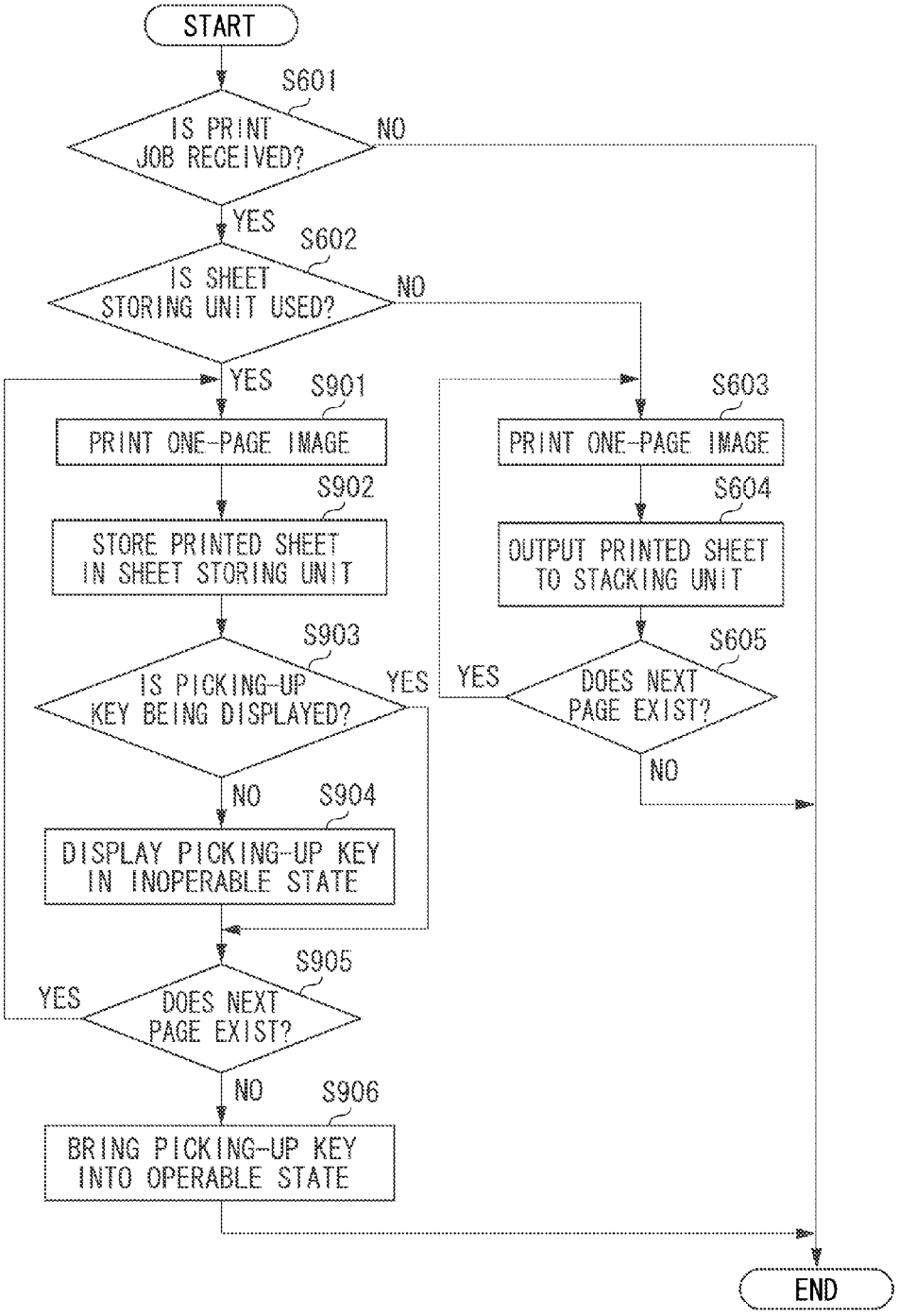
FIG. 9 is a flow chart illustrating the operation of the printing apparatus according to the exemplary embodiment.

FIG. 9 is a flow chart which corresponds to the flow chart in FIG. 6 according to the first exemplary embodiment and describes the operation of the printing apparatus 100 in a case where a print job is received from the client PC 620. Each operation (step) illustrated in the flow chart in FIG. 9 is realized by the control unit 501 of the printing apparatus 100 executing the control program stored in the ROM 503. The flow chart in FIG. 9 shall be continuously executed (that is, the process proceeds from the start to the end and thereafter the process is resumed without substantial intermission). Steps S601 to S605 are similar to those described in FIG. 6, so that the description thereof is omitted herein.

In step S901, a one-page image based on the print job is printed on the sheet. In step S902, the printed sheet is stored in the sheet storing unit 202 (here is described an example in which the printed sheet is stored in the sheet storing unit 202 among the three sheet storing units). If a plurality of pages is printed on one sheet, in step S901, images for the plurality of pages are collectively printed.

In step S903, it is determined whether a picking-up key corresponding to the sheet storing unit 202 is already displayed. If it is determined that the picking-up key is already displayed (YES in step S903), the processing proceeds to step S905. If it is determined that the picking-up key is not yet displayed (NO in step S903), the processing proceeds to step S904.

In step S904, the picking-up key corresponding to the sheet storing unit 202 is displayed in an inoperable state. In step S905, it is determined whether the next page exists. If the next page exists (YES in step S905), the processing returns to step S901. If the next page does not exist (NO in step S905), the processing proceeds to step S906. In step S906, the picking-up key displayed in an inoperable state is brought into an operable state and the processing ends.

Figure 10A:
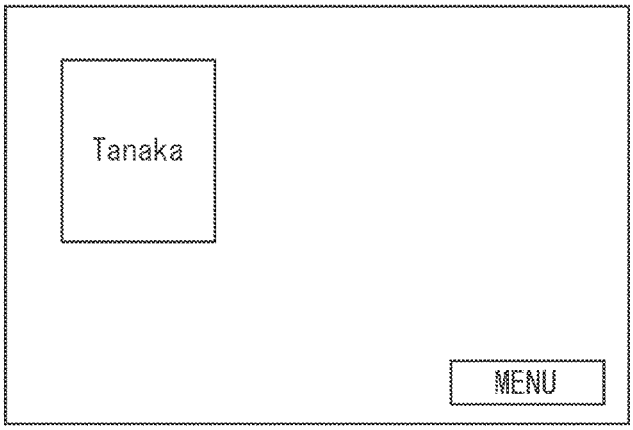
FIGS. 10A, 10B, and 10C illustrate examples of screens displayed on the printing apparatus according to the exemplary embodiment.
Figure 10B:
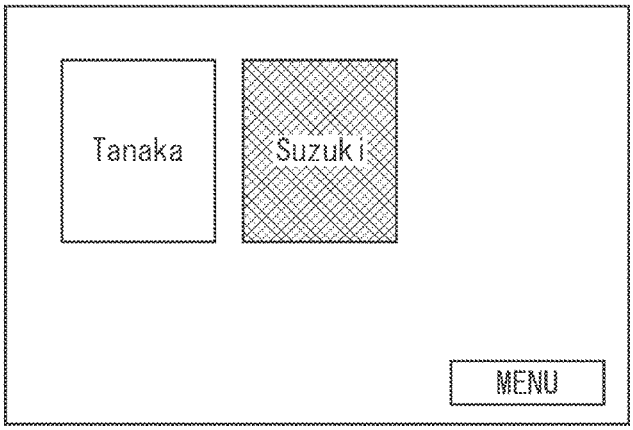
Figure 10C:
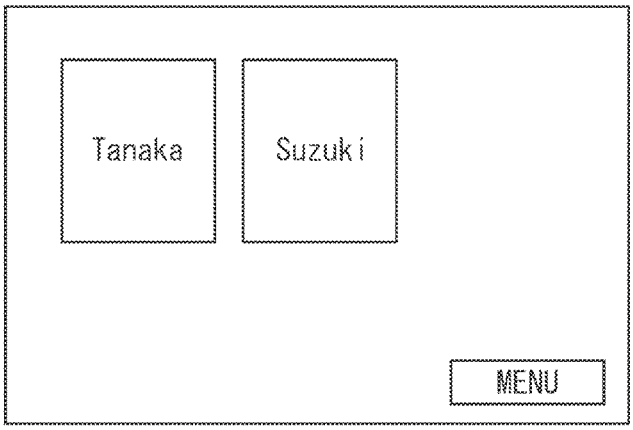

FIGS. 10A, 10B, and 10C correspond to the examples of screens illustrated in FIGS. 7A, 7B, and 7C according to the first exemplary embodiment and are the examples of screens for receiving instructions for picking up. FIG. 10A illustrates a state where the sheet having a user name, "Tanaka", is stored in the sheet storing unit 201. If the job having the user name, "Suzuki", is executed in this state, the display screen is changed into a state illustrated in FIG. 10B by the processing in step S904. The comparison of FIG. 10A with FIG. 10B reveals that a display object displaying a name of "Suzuki" is added as the picking-up key corresponding to the sheet storing unit 202. However, the display object displaying a name of "Suzuki" is grayed-out and is placed in the inoperable state. Thereafter, if the printing based on the job having the user name, "Suzuki", is completed, the display screen is changed to the one illustrated in FIG. 10C. The comparison of FIG. 10B with FIG. 10C reveals that the display object displaying the name of "Suzuki" is switched from the inoperable state to an operable state.

Figure 11:
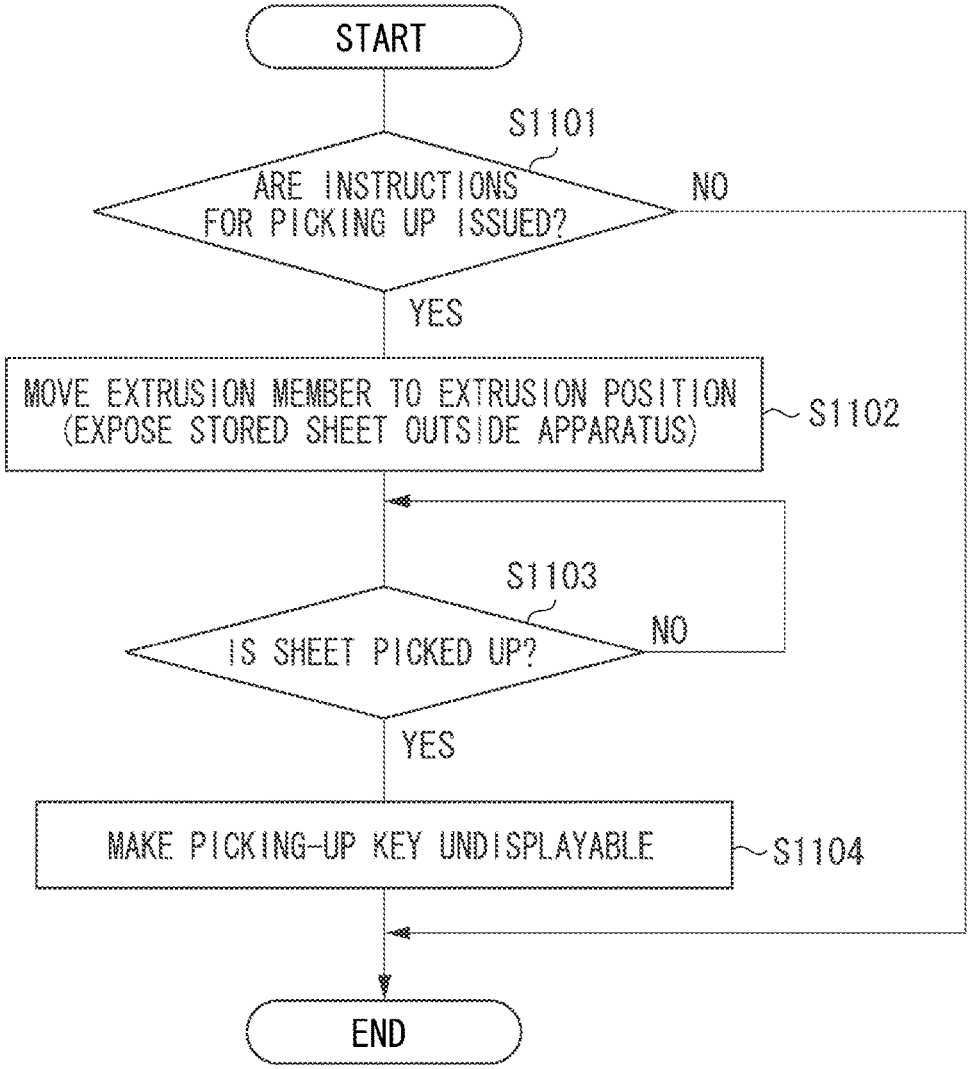
FIG. 11 is a flow chart illustrating the operation of the printing apparatus according to the exemplary embodiment.

FIG. 11 is a flow chart which corresponds to the flow chart in FIG. 8 according to the first exemplary embodiment and describes the operation of the printing apparatus 100 in a case where the user picks up the sheet stored in the sheet storing unit. Each operation (step) illustrated in the flow chart in FIG. 11 is realized by the control unit 501 of the printing apparatus 100 executing the control program stored in the ROM 503. The flow chart in FIG. 11 shall be continuously executed (that is, the process proceeds from the start to the end and thereafter the process is resumed without substantial intermission).

In step S1101, it is determined whether instructions to pick up the sheet are issued. If the picking-up key displayed in an operable state among the picking-up keys illustrated in FIGS. 10A, 10B, and 10C is operated, it is determined that the instructions to pick up the sheet are issued (YES in step S1101) and the processing proceeds to step S1102. If it is determined that the instructions to pick up the sheet are not issued (NO in step S1101), the processing ends.

In step S1102, the extrusion member 233 is moved to the extrusion position to expose the stored sheet outside. In step S1103, it is determined whether the sheet exposed in step S1102 is picked up based on a result detected by the member 106. If it is determined that the sheet is picked up (YES in step S1103), the processing proceeds to step S1104 to render the picking-up key in an undisplayable state. At this point, the extrusion member 233 is returned to the stack position.

As described above, according to the second exemplary embodiment, the picking-up key is displayed in an inoperable state so that instructions to pick up the sheet from the sheet storing unit are not issued while the sheet storing unit is being used for printing. This can prevent the user from issuing instructions to pick up the sheet without knowing that the sheet cannot be picked up instantly.

The third exemplary embodiment is described below. The first and second exemplary embodiments describe examples in which the picking-up key is displayed in response to the storing of one-page sheet (first page) in the sheet storing unit. On the other hand, the third exemplary embodiment describes an example in which the picking-up key is displayed in response to the storing of all sheets corresponding to one job in the sheet storing unit. The third exemplary embodiment also describes an operation in a case where the sheet corresponding to a plurality of jobs is stored into the sheet storing unit. In what follows, only points different from those of the first and second exemplary embodiments are described and points other than that shall be the same as those of the first and second exemplary embodiments.

Figure 12:
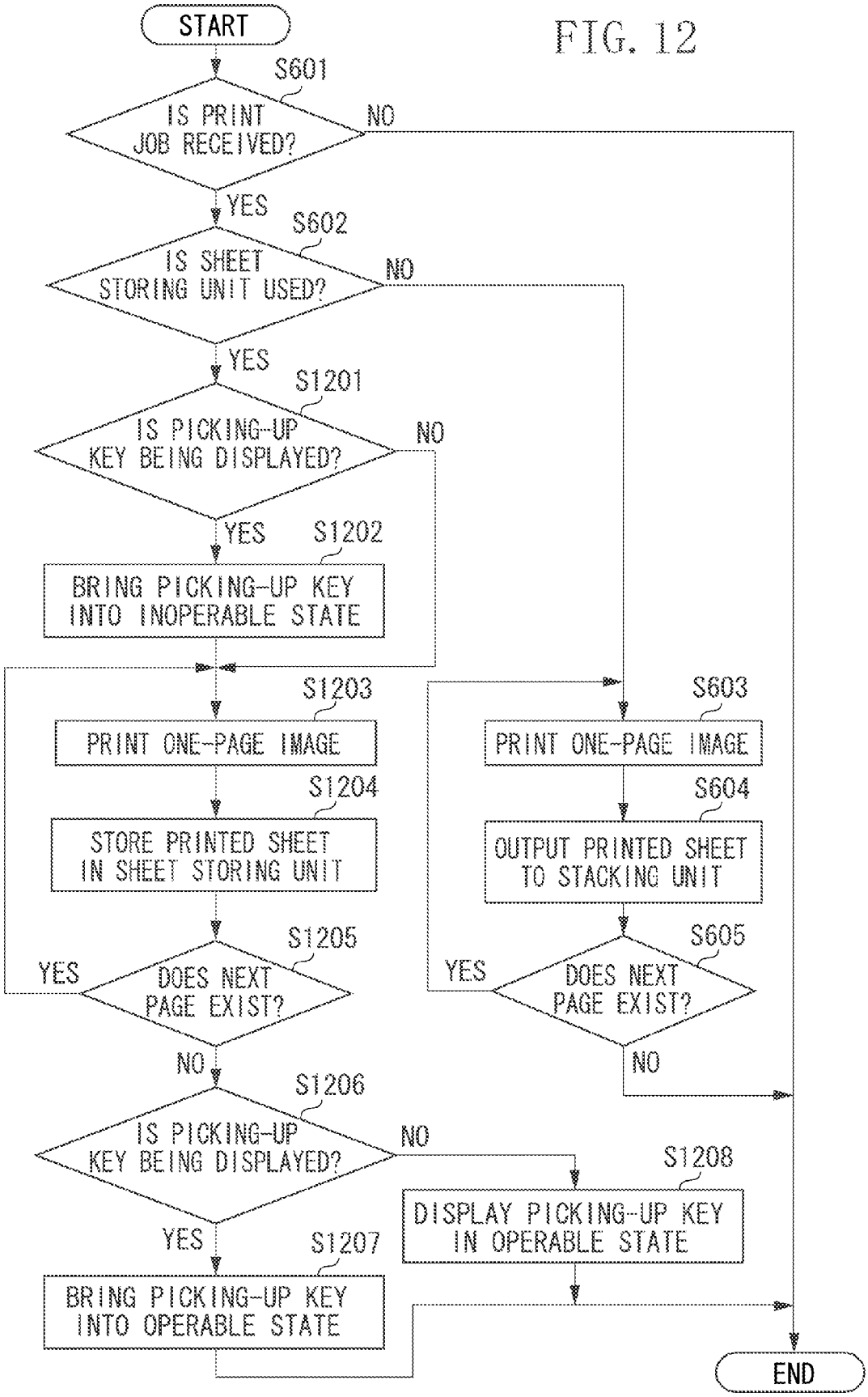
FIG. 12 is a flow chart illustrating the operation of the printing apparatus according to the exemplary embodiment.

FIG. 12 is a flow chart corresponding to FIG. 6 according to the first exemplary embodiment and describing the operation of the printing apparatus 100 in a case where a print job is received from the client PC 620. Each operation (step) illustrated in the flow chart in FIG. 12 is realized by the control unit 501 of the printing apparatus 100 executing the control program stored in the ROM 503. The flow chart in FIG. 12 shall be continuously executed (that is, the process proceeds from the start to the end and thereafter the process is resumed without substantial intermission). Steps S601 to S605 are similar to those described in FIG. 6, so that the description thereof is omitted herein.

In step S1201, it is determined whether a picking-up key corresponding to the sheet storing unit 202 is already displayed. The case where the picking-up key corresponding to the sheet storing unit 202 is already displayed is a case where another job different from the job to be executed from now is previously executed and the sheet corresponding to the previous job is stored in the sheet storing unit 202. If it is determined that the picking-up key is already displayed (YES in step S1201), the processing proceeds to step S1202. If it is determined that the picking-up key is not yet displayed (NO in step S1201), the processing proceeds to step S1203.

In step S1202, the displayed picking-up key is brought into an inoperable state. In step S1203, a one-page image based on the print job is printed on the sheet. In step S1204, the printed sheet is stored in the sheet storing unit 202. In step S1205, it is determined whether the next page exists. If the next page exists (YES in step S1205), the processing returns to step S1203. If the next page does not exist (NO in step S1205), the processing proceeds to step S1206.

In step S1206, it is determined whether the picking-up key corresponding to the sheet storing unit 202 is already displayed. If it is determined that the picking-up key is already displayed (YES in step S1206), the processing proceeds to step S1207. If it is determined that the picking-up key is not yet displayed (NO in step S1206), the processing proceeds to step S1208. In step S1207, the picking-up key displayed in an inoperable state is brought into an operable state. In step S1208, the picking-up key is newly displayed in an operable state.

Figure 13A:
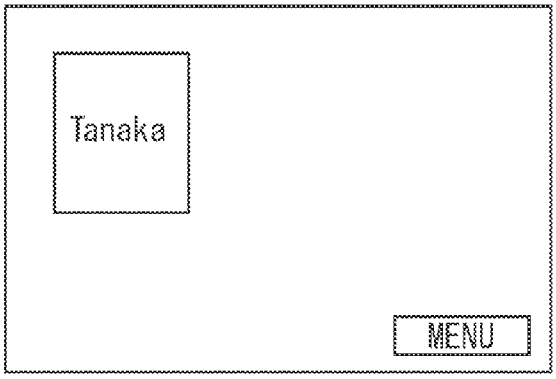
FIGS. 13A, 13B, 13C, and 13D illustrate examples of screens displayed on the printing apparatus according to the exemplary embodiment.
Figure 13B:
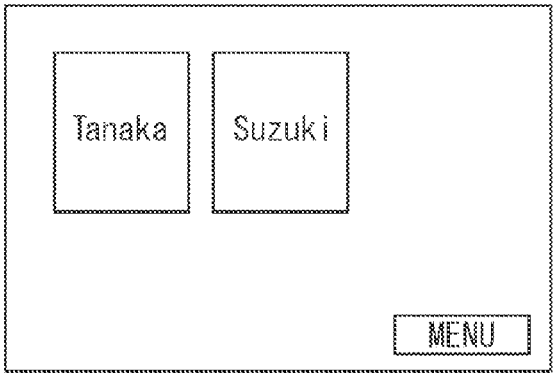
Figure 13C:
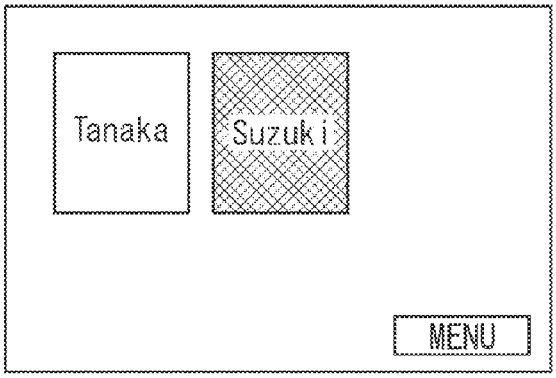
Figure 13D:
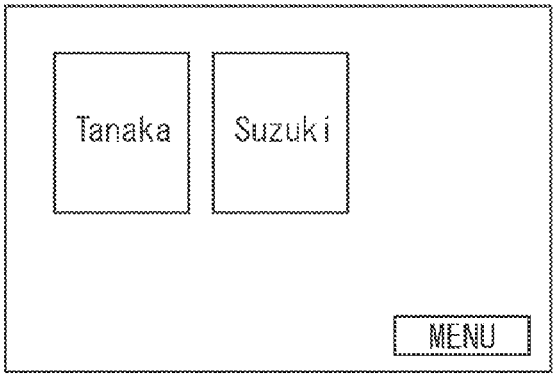

FIGS. 13A, 13B, 13C, and 13D correspond to examples of the screens in FIGS. 7A, 7B, and 7C according to the first exemplary embodiment and illustrates an example of the screen for receiving instructions to pick up the sheet. FIG. 13A corresponds to a state where the sheet having a user name, "Tanaka", is stored in the sheet storing unit 201. If a job of a user having a name is "Suzuki" is executed in this state, the display screen is changed to a state illustrated in FIG. 13B through the processing in step S1208. The comparison of FIG. 13A with FIG. 13B reveals that a display object displaying a name of "Suzuki" is added as the picking-up key corresponding to the sheet storing unit 202. If another job having a user name, "Suzuki", is additionally executed, the display screen is changed to a state illustrated in FIG. 13C through the processing in step S1202. The display object displaying a name of "Suzuki" is grayed out and made temporarily inoperable. Thereafter, if the printing based on the job is completed, the display screen is changed to the one illustrated in FIG. 13D through the processing in step S1207. The comparison of FIG. 13C with FIG. 13D reveals that the display object displaying the name of "Suzuki" is changed from inoperable to operable states.

As described above, according to the third exemplary embodiment, the picking-up key is displayed in response to the printing based on one job being completed, thereafter, if another job is executed, the displayed picking-up key is brought into a temporarily inoperable state. According to the third exemplary embodiment, the sheet is picked up according to the flow chart illustrated in FIG. 11.

[Other Exemplary Embodiments]

Exemplary embodiments can be achieved by executing the following process. The process is such that the storage medium recording the program code of software realizing the functions of the above exemplary embodiments is supplied to a system or the apparatus and a computer (a CPU or a micro processing unit (MPU)) of the system or the apparatus reads the program code stored in the storage medium.

In this case, the program code itself read from the storage medium realizes the functions of the above exemplary embodiments and the program code and the storage medium storing the program code configure the present disclosure.

Other Embodiments

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-135385, filed Jun. 30, 2014, which is hereby incorporated by reference herein in its entirety.

What is claimed is:

1. A printing apparatus comprising:

a printing unit configured to print an image on a sheet;

a conveyance path configured to convey the sheet on which the image is printed by the printing unit;

a sheet stacking unit on which the sheet discharged from the conveyance path is stacked inside the printing apparatus;

an extrusion member configured to push an edge of the sheet stacked on the sheet stacking unit such that a part of the stacked sheet is exposed outside the printing apparatus via a discharge port, wherein the extrusion member is reciprocated between a stack position and an extrusion position;

an operation unit configured to input a user instruction for picking up the sheet; and a control unit configured to control the extrusion member to move from the stack position to the extrusion position in response to the user instruction input by the operation unit, wherein the control unit controls the movement of the extrusion member from the stack position to the extrusion position to be restricted while the printing unit prints an image on a sheet to be stored in the sheet stacking unit.

2. The printing apparatus according to claim 1, wherein the operation unit is configured to display a picking-up key corresponding to the sheet stacking unit for receiving the user instruction, and wherein the control unit controls the operation unit not to display the picking-up key while the sheet stacking unit prints an image on a sheet to be stacked on the sheet stacking unit.

3. The printing apparatus according to claim 2, wherein the operation unit displays the picking-up key in response to stacking of one sheet in the sheet stacking unit.

4. The printing apparatus according to claim 2, wherein the operation unit displays the picking-up key in response to storing of all sheets corresponding to one job in the sheet stacking unit.

5. The printing apparatus according to claim 2, wherein the operation unit displays the operation key in the inoperable state when the sheets corresponding to other jobs are stored in the storage unit.

6. The printing apparatus according to claim 1 further comprising a sheet removable stacking unit configured to stack a sheet printed with an image printed by the printing unit, wherein a sheet in the sheet removable stacking unit is removable without the user instruction.

7. The printing apparatus according to claim 6, wherein the printing unit is provided between the sheet removable stacking unit and the sheet stacking unit.

8. The printing apparatus according to claim 6, wherein the sheet removable stacking unit and the sheet stacking unit are provided at upper portion of the printing unit.

9. The printing apparatus according to claim 1, further comprising a receiving unit configured to receive a printing job, wherein the control unit analyzes the printing job received by the receiving unit and determines whether to discharge a sheet to be printed by the printing unit to the sheet stacking unit.

10. The printing apparatus according to claim 1, wherein the extrusion member comprises a sheet trailing-edge extrusion claw, and wherein the stack position is a position where the sheet discharged from the conveyance path and the sheet trailing-edge extrusion claw do not interfere with each other.

11. The printing apparatus according to claim 10, wherein the extrusion position is a position where the sheet discharged from the conveyance path interferes with the sheet trailing-edge extrusion claw.

12. The printing apparatus according to claim 1 further comprising:

a detecting unit configured to detect that a sheet is removed from the discharge port, wherein the control unit causes the extrusion member to move from the extrusion position to the stack position based on the detection result acquired by the detecting unit.

13. The printing apparatus according to claim 1, wherein, in a case where the user instruction is input from the operation unit, the control unit determines whether the printing unit is printing an image on a sheet to be stored to the sheet stacking unit, and when it is determined that the printing unit is printing an image on the sheet, the control unit displays a warning message to the operation unit and restricts a movement of the extrusion member from the stack position to the extrusion position.

14. The printing apparatus according to claim 13, wherein the warning message is a message to inform that a sheet stacking unit selected by a user is currently used for printing process.

15. The printing apparatus according to claim 13, wherein the warning message is a message to inform a necessity to wait until a printing process to complete.

* * * * *